US006260564B1

(12) United States Patent
Sylvain et al.

(10) Patent No.: US 6,260,564 B1
(45) Date of Patent: Jul. 17, 2001

(54) DEVICE FOR CLOSING A TANK CONTAINING A CORROSIVE PRODUCT

(75) Inventors: Daniel Sylvain, Verneuil sur Seine; Henri Bonhomme, Saint Etienne, both of (FR)

(73) Assignee: Vai Clecim, Nanterre Cedex ( * ) Notice: Subject to any disclaimer, the term of this patent is extended or adjusted under 35 U.S.C. 154(b) by 0 days.

(21) Appl. No.: 09/346,921

(22) Filed: Jul. 2, 1999

(30) Foreign Application Priority Data

Oct. 7, 1998 (FR) ..... 98 08945

(51) Int. Cl.[7] ..... B08B 15/02

(52) U.S. Cl. ..... 134/64 R; 134/122 R; 134/200

(58) Field of Search ..... 134/64 R, 122 R, 134/84, 85, 86, 108, 96, 201, 200

(56) References Cited

U.S. PATENT DOCUMENTS

| | | | |
|---|---|---|---|
| 2,216,544 | * | 10/1940 | True et al . |
| 3,473,791 | | 10/1969 | White et al. . |
| 3,648,593 | * | 3/1972 | Marshall . |
| 3,803,996 | | 4/1974 | Marshall . |
| 4,391,692 | * | 7/1983 | Mindt . |
| 4,592,784 | * | 6/1986 | Ghizzi . |
| 4,604,157 | * | 8/1986 | Damiron et al. . |
| 4,901,744 | * | 2/1990 | Hansen . |
| 5,116,447 | * | 5/1992 | Kimura et al. . |
| 5,248,372 | * | 9/1993 | McNamee . |
| 5,547,101 | * | 8/1996 | Haquin et al. . |
| 5,566,694 | * | 10/1996 | Pugh et al. . |

FOREIGN PATENT DOCUMENTS

| | | | |
|---|---|---|---|
| 1546204 | * | 3/1969 | (DE) . |
| 1 303 381 | | 10/1971 | (DE) . |
| 3623197 | * | 9/1987 | (DE) . |
| 2 680 181 | | 2/1993 | (FR) . |
| 53-120636 | * | 10/1978 | (JP) . |
| 63-274788 | * | 11/1988 | (JP) . |

* cited by examiner

*Primary Examiner*—Frankie L. Stinson
(74) *Attorney, Agent, or Firm*—Arent Fox Kintner Plotkin & Kahn, PLLC

(57) ABSTRACT

The purpose of the invention is a device for closing a tank (1) containing a corrosive product closed by at least two successive lids (5) whose two longitudinal sides (6) engage, upon closing, into two corresponding gutters (7) of the tank (1) which are filled with water in order to constitute a tight seal, so-called 'water seal'. According to the invention, at least one additional medial, also U-section, transversal gutter (12) is interposed between both longitudinal gutters (7) of the tank (1) at a sealing plane (P) between two successive lids (5) whose opposite transversal sides (8) engage into the said transversal gutter (12) in order to form a water seal on at least three sides of each lid.

6 Claims, 1 Drawing Sheet

DEVICE FOR CLOSING A TANK CONTAINING A CORROSIVE PRODUCT

The present invention relates to a device for closing an oblong tank containing a corrosive product, in particular an acid pickling tank for a strip-type product such as a metal sheet.

The metal strips produced in a rolling installation must normally undergo a pickling operation, in particular after hot rolling and before cold rolling, in. order to eliminate the oxide formed at their surface during hot rolling as well as other deposits or contaminations liable to nest into the sheet during cold rolling.

Generally, sheet pickling is performed while passing the metal strip through a series of tanks containing a hot sulphuric or hydrochloride acid solution. At each extremity of a tank, the strip passes over a threshold placed above the upper level of the acid bath, then is immersed into the said bath while forming a catenary loop up to the threshold placed at the other extremity of the tank. The strip must be stretched sufficiently to be immersed over a certain length inside the bath without increasing the height of the tank excessively.

Each tank must therefore be very long, for instance 20 to 30 meters with a constant width over its whole length, which depends on the maximum width of the strips thus treated.

A pickling bath consists therefore, generally, of a vessel exhibiting a rectangular bottom whose length is quite impressive with respect to its width, and a vertical lateral wall comprising two longitudinal faces and two transversal faces.

The installation generally comprises several tanks in succession and the assembly is placed inside a large-sized building. As the acid is hot, vapours are emitted, liable to corrode all the material placed above and around the tanks and must therefore be detected, then directed towards depollution units.

To this end, each tank is generally closed by a lid applied as tight as possible onto the upper rim of the lateral walls and connected to a suction means enabling to depressurise the inside of the tank as far as acceptable in relation to the outside, in order to prevent any leaks.

It is therefore necessary to guarantee tightness of the seal between the lid and the lateral side and, in this view, it is advantageous to use a so-called 'water seal' device, composed of a U-section gutter open upwards and filled with water, arranged along the upper rim of each longitudinal wall of the tank and in which a lateral rim of the lid is partially immersed.

However, because of the very great length of the tanks, it is necessary, in order to manipulate them, to cover each tank using several lids placed in. succession. Accordingly, it has seemed natural, up to now, to place water seals exclusively on the longitudinal walls of each tank, whereas tightness along each transversal sealing plane between two successive lids is ensured by rubber seals or any other sealing material, which are placed along adjacent transversal rims of both successive lids and overlap one another.

Similarly, at both extremities of each tank, the strip passes generally over a threshold or between rinsing rolls placed in a cover over which the corresponding transversal rim of the first or the last lid presses, via a sealing joint.

However, further to high corrosive power of acid vapours, the sealing joints wear rapidly and tightness is not always ensured perfectly, even if the seals are replaced periodically. Moreover, taking into account that the transversal seals between two successive lids overlap each other, they may deteriorate if the lids are not lifted in the correct order.

These deteriorations call for increasing the suction rate in order to maintain the inside of the tank depressurised with respect to the outside, but this increases air drafts at the surface of the bath, therefore evaporation and, consequently, vapour formation, as well as energy consumption of the line.

The invention aims at remedying these shortcomings thanks to new arrangements enabling better tightness over the whole circumference of each lid.

The invention relates therefore to a device for closing an oblong tank containing a corrosive product, whereas the said tank contains a rectangular bottom surrounded by a lateral wall with an upper rim and comprising two longitudinal sides and two extreme transversal sides delineating an upper aperture, whereby the closing system comprises:

at least two successive lids extending respectively on either side of at least one sealing plane, whereas each lid has a lateral rim comprising two longitudinal sides and at least one transversal side extending along the sealing plane, two longitudinal U-section gutters, arranged respectively along the upper rims of both longitudinal sides of the lateral wall of the tank, at least one medial transversal gutter extending along at least one sealing plane between both longitudinal gutters, whereby the said longitudinal and transversal gutters are filled with water, whereby the longitudinal sides and at least one transversal side of each lid engage, upon closing, respectively into the said longitudinal and transversal gutters in order to constitute an efficient 'water seal' on at least three sides of the said lid.

Preferably, each longitudinal gutter is fitted, at each medial gutter, with an aperture enabling both gutters, respectively longitudinal and transversal gutters, to communicate, in order to provide a continuous water seal.

Usually, each tank is fitted, at each extremity, with a threshold above the bath, to allow passage of the strip, whereas the said threshold can consist of two superimposed rolls between which the strip passes so that the latter can be rinsed.

Particularly advantageously, such a threshold is covered with a cover along which is placed a transversal gutter linking with the corresponding extremities of both longitudinal gutters in order to establish tightness via a water seal on the four sides of each lid.

According to another advantageous characteristic, the medial transversal gutters can be fitted, at each extremity, with removable junction means with the corresponding side of each longitudinal gutter, in order to allow disassembly of the medial gutters if necessary.

But the invention will be better understood using the following description of a peculiar embodiment, given for exemplification purposes and represented on the appended drawings.

Figure 1:
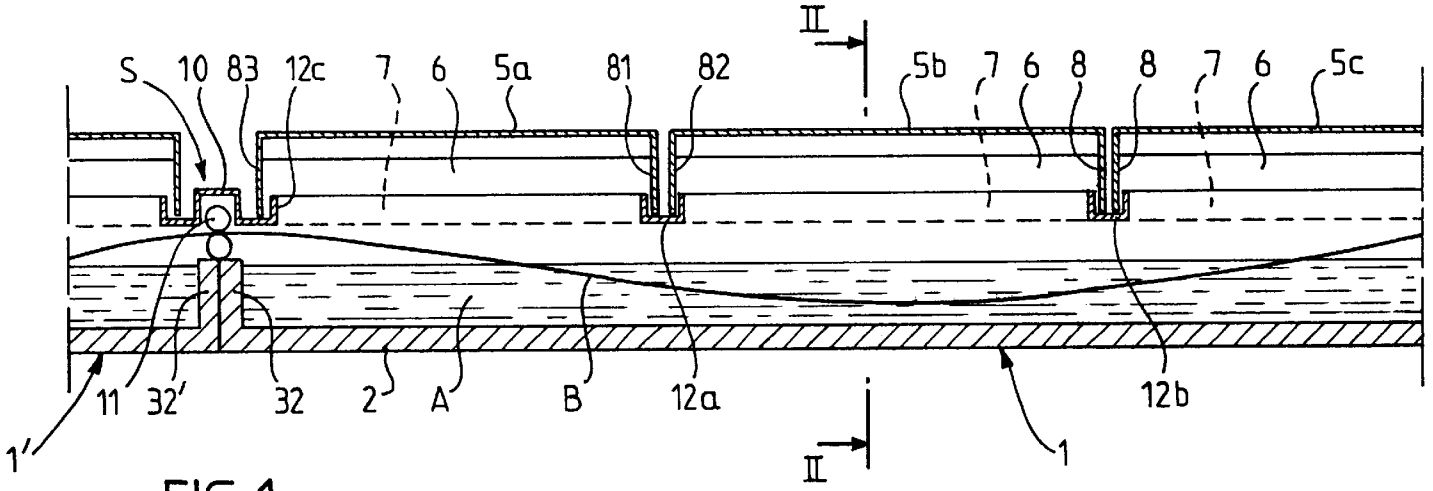
FIG. 1 is a partial diagrammatic view, as a longitudinal section, of a pickling tank fitted with a closing device according to the invention.
Figure 2:
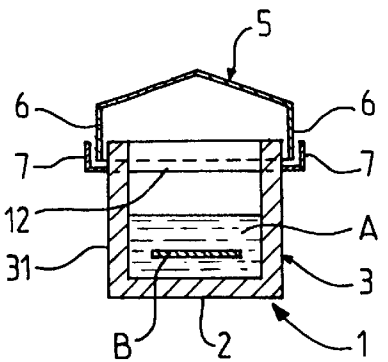
FIG. 2 is a transversal sectional view along the line 11—11 of FIG. 1.
Figure 3:
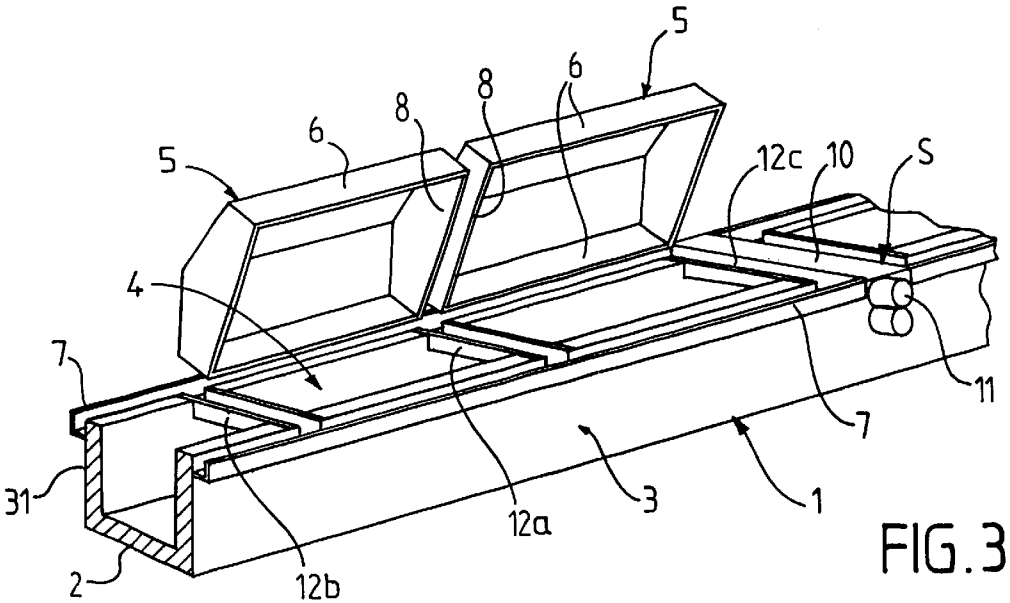
FIG. 3 is a partial perspective view of a pickling tank, whereas the lids are open.

FIG. 1 is a diagrammatic representation, as a longitudinal section, of the extremity of a pickling tank 1 consisting of an oblong vessel with a very long rectangular bottom 2, surrounded by a lateral wall 3 with two longitudinal sides 31 parallel to the direction of the strip and two transversal sides 32 closing the extremities of the tank.

Usually, a pickling installation comprises several successive tanks containing baths of different concentrations and in which the strip plunges in succession thereby forming a loop. FIG. 1, for example, represents diagrammatically the junction between two tanks 1, 1'. The adjacent transversal sides 32, 32' of two successive tanks have an upper rim placed above the level of the acid bath A and constitute a threshold S for the passage of the strip B thereby forming, in each tank, a catenary-shaped loop between two successive thresholds S.

Each threshold S can be constituted of a solid part fitted with a rounded upper face over which the strip passes, whereby this part is made of a corrosion-resistant material, for instance granite, lava of volcanic origin or a ceramic product.

However, the strip can be made to pass between two superimposed rolls 11, in particular between two successive tanks, in order to rinse the strip when leaving the tank in order to prevent, as far as possible, transportation of an acid of different concentration into the following tank.

The upper rim of the upper wall 3 delineates a rectangular aperture 4 which must be closed in order to avoid excessive vapour emission, whereas acid is hot.

In practice, several successive lids 5 are used since a single lid would be too difficult to handle, taking into account the sizes of the tank.

Each of the said lids 5 is fitted with a lateral rim 6 liable to engage, upon closing, into a corresponding U-section gutter 7, provided on the upper rim of s the lateral wall 3 of the tank 1.

The gutter 7 is filled with water in order to constitute a tight joint, so-called 'water seal'.

Until now, the waters seals 7 were provided exclusively along the longitudinal sides 31 of the tanks and 61 of each lid 5 since it seemed necessary to clear the upper aperture 4 of the tank completely in order to enable retraction of the strip by lifting it should the line stop. Consequently, at each transversal sealing plane P between two successive lids 5*a,* 5*b,* tightness was provided by rubber seals provided along the adjacent transversal sides 81, 82 of both lids and overlap one another, which exhibits the shortcomings mentioned above.

According to the invention, on the contrary, a water seal is provided at least on three sides of the extreme lids 5*a,* 5*c* and over the whole circumference of the intermediate lid 5*b.*

To this end, the longitudinal gutters 7 provided on either side of the upper rim of the lateral wall 3 of the tank 1 are connected together via at least one additional medial, also U-section, transversal gutter 12 and into which, upon closing, both opposite transversal sides 81, 82 of two successive lids 5*a,* 5*b* are liable to engage, in order to constitute an efficient 'water seal' over at least three sides 6, 7, 8 of each of them.

When the tank 1 is closed by three successive lids 5*a,* 5*b,* 5*c,* as represented on FIG. 1, two medial transversal gutters 12*a,* 12*b* connected to the longitudinal gutters 7 are used in order to enable, upon closing, respectively the opposite transversal sides 8 of the three lids to engage in order to constitute an efficient 'water seal', at least over the whole circumference of the intermediate lid 5*b.* At both extremities of the tank, it is possible to ensure tightness of the lid using a rubber seal applied onto a cover 10 covering the threshold S. To this end, at this place, the joints do not overlap each other. Besides, it can even be contemplated not to arrange the seal at the inlet, for example for the first tank in which the temperature of the acid bath is not very high, which does restrict vapour emissions.

However, it is preferable to provide a continuous water seal for the end lids as well.

To this end, as represented on FIG. 1, the threshold S, which comprises, for instance two rinsing rolls 11, is covered with a cover 10 along which is provided a transversal gutter 12*c* extending between both extremities of both longitudinal gutters 7 and whose bottom is placed slightly above the passage level of the strip so as not to disturb the passage of the said strip.

It is obvious that, in the disposition according to the invention, the medial transversal gutters 12*a,* 12*b* pass above the strip, thereby preventing the retraction of the said gutters should the line stop.

However, modern installations are fitted with rinsing rolls that, in any case, make any removal of the strip from the top cumbersome, unless the said rolls are removed as well.

Moreover, it has appeared that, taking into account the evolution of the technique, the upper aperture of the tank need not be maintained clear any longer.

For all these reasons, it seems that the shortcoming associated with the presence of the medial gutters is quite relative and largely compensated for by the advantage provided by this invention for tightness improvement.

Besides, removable assembly of the medial gutters 12*a,* 12*b* can also be contemplated, whereby each gutter can be nested, at its extremities, into an aperture provided on the internal face of the longitudinal gutter 7, at the required height, using a tightness maintenance means, whereas the gutter can obviously be removed after draining water from the seal.

Anyway, the invention is not limited to the details of the embodiment just described for exemplification purposes and which could be subject to variations without departing from the protection framework defined by the claims.

What is claimed is:

1. A device for closing an oblong tank (1) containing a corrosive product, whereas the said tank (1) comprises a rectangular bottom (2) surrounded by a lateral wall (3) with an upper rim and comprising two longitudinal sides (31) and two extreme transversal sides (32) delineating an upper aperture (4), whereby the closing system comprises:

at least two successive lids (5) extending respectively on either side of at least one sealing plane P, whereas each lid (5) has a lateral rim comprising two longitudinal sides (6) and at least one transversal side (8) extending along the sealing plane P, two longitudinal U-section gutters (7), arranged respectively along the upper rims of both longitudinal sides (31) of the lateral wall (3) of the tank (1), at least one medial transversal gutter (12) extending along at least one sealing plane P between both longitudinal gutters (7), whereby the said longitudinal (7) and transversal (12) gutters are filled with water, whereby the longitudinal sides (6) and at least one transversal side (8) of each lid (5) engage, upon closing, respectively into the said longitudinal (7) and transversal (12) gutters in order to constitute an efficient 'water seal' on at least three sides of the said lid (5).

2. A device according to claim 1, characterised in that each longitudinal gutter (7) is fitted, at each transversal gutter (12), with an aperture enabling both gutters, respectively longitudinal (7) and transversal (12) gutters, to communicate, in order to provide a continuous water seal.

3. A device according to one of the claims 1 and 2, in which the tank (1) comprises at least two medial transversal gutters (12*a,* 12*b*) connected to the longitudinal gutters (7), whereas the longitudinal sides (6) and the opposite transversal sides (8), of at least three successive lids (5*a,* 5*b,* 5*c*) engage, upon closing, into the said gutters, respectively longitudinal (7) and transversal (12) gutters, in order to constitute an efficient 'water seal' on at least three sides for the extremity lids (5*a,* 5*c*) and on four sides for at least an intermediate lid (5*b*).

4. A device according to claim 3, in which the tank (1) comprises two extremity transversal gutters (12*c*), each connected to the extremities of the longitudinal gutters (7) and into which engage, upon closing, the end transversal sides (83) of two end lids (5*a,* 5*b*) in order to constitute an efficient 'water seal' on four sides of the said lids.

5. A device according to claim 4, for treating a strip-type product in contact with a treatment liquid contained in the tank and with an upper level, whereas the tank is fitted, at each extremity (3, 2), with a passage threshold (S) of the product above the upper level of the treatment liquid, in which the end transversal gutters (12*c*) are each provided along a cover (10) covering the threshold (S) at the corresponding extremity (32) of the tank (1).

6. A device according to one of the claims 1 and 2, in which each medial transversal gutter (12*a*) is connected removable to both longitudinal gutters (7).

* * * * *